US006918359B2

(12) United States Patent
Klaric et al.

(10) Patent No.: US 6,918,359 B2
(45) Date of Patent: Jul. 19, 2005

(54) RIGID CONNECTING DUCT

(75) Inventors: Igor Klaric, Korb (DE); Ernst Buck, Leutenbach (DE)

(73) Assignee: Andreas Stihl AG & Co KG (DE)

( * ) Notice: Subject to any disclaimer, the term of this patent is extended or adjusted under 35 U.S.C. 154(b) by 0 days.

(21) Appl. No.: 10/439,034

(22) Filed: May 15, 2003

(65) Prior Publication Data

US 2003/0217708 A1 Nov. 27, 2003

(30) Foreign Application Priority Data

May 21, 2002 (DE) ..... 102 22 346

(51) Int. Cl.[7] ..... F02B 25/22
(52) U.S. Cl. ..... 123/73 A; 123/65 P
(58) Field of Search ..... 123/73 PP, 73 A, 123/73 R, 65 P, 65 R

(56) References Cited

U.S. PATENT DOCUMENTS 6,112,708 A * 9/2000 Sawada et al. ..... 123/73 PP
6,352,058 B1 3/2002 Yuasa et al.
6,598,568 B2 * 7/2003 Rosskamp et al. ..... 123/73 PP
6,634,326 B2 * 10/2003 Radel et al. ..... 123/73 PP
6,640,755 B2 * 11/2003 Araki ..... 123/73 PP
6,691,650 B2 * 2/2004 Zama et al. ..... 123/73 PP
2002/0139326 A1 10/2002 Araki

FOREIGN PATENT DOCUMENTS

EP 0 997 621 5/2000
WO WO 00/43650 7/2000

* cited by examiner

*Primary Examiner*—Mahmoud Gimie
*Assistant Examiner*—Hyder Ali
(74) *Attorney, Agent, or Firm*—Robert W Becker & Associates; Robert W Becker

(57) ABSTRACT

A portable, manually-guided implement, such as a cut-off machine, is provided and has an internal combustion engine, a cylinder of which has a combustion chamber with an exhaust gas outlet. The combustion chamber is delimited by a piston that, via a connecting rod, drives a crankshaft rotatably mounted in a crankcase. Disposed on both sides of a central plane of the cylinder are transfer channels that respectively connect the crankcase with the combustion chamber. The first end of a transfer channel is connected via an inlet window with the combustion chamber, while the second end of the transfer channel is open toward the crankcase. The transfer channels are connected with an air duct that, via a control member, supplies essentially fuel-free combustion air from an air filter. A duct section of the air duct is formed in a housing wall disposed between the carburetor and the engine cylinder.

22 Claims, 4 Drawing Sheets

RIGID CONNECTING DUCT

BACKGROUND OF THE INVENTION

The present invention relates to a portable, manually operated implement, in particular a cut-off machine, power chain saw, blower or similar device.

To reduce scavenging losses of a two-cycle engine in order to achieve better exhaust emission values it is known from WO 00 43650 to supply to the transfer channels fresh air positioned forward of the mixture to be introduced. In the scavenging phase in the combustion chamber, the fresh air will first enter the combustion chamber and form a large part of the unavoidable scavenging losses. In order to supply the forward positioned scavenging air, duct connections are required between an air filter and the cylinder of the internal combustion engine which require additional space for installation. There is frequently insufficient installation space available in portable, manually operated implements and the creation of forward positioned scavenging air in manually operated implements is therefore complex.

The object of the invention is to design a portable, manually operated implement in such a manner that sufficient installation space is available for air ducts which run parallel to the mixing path.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
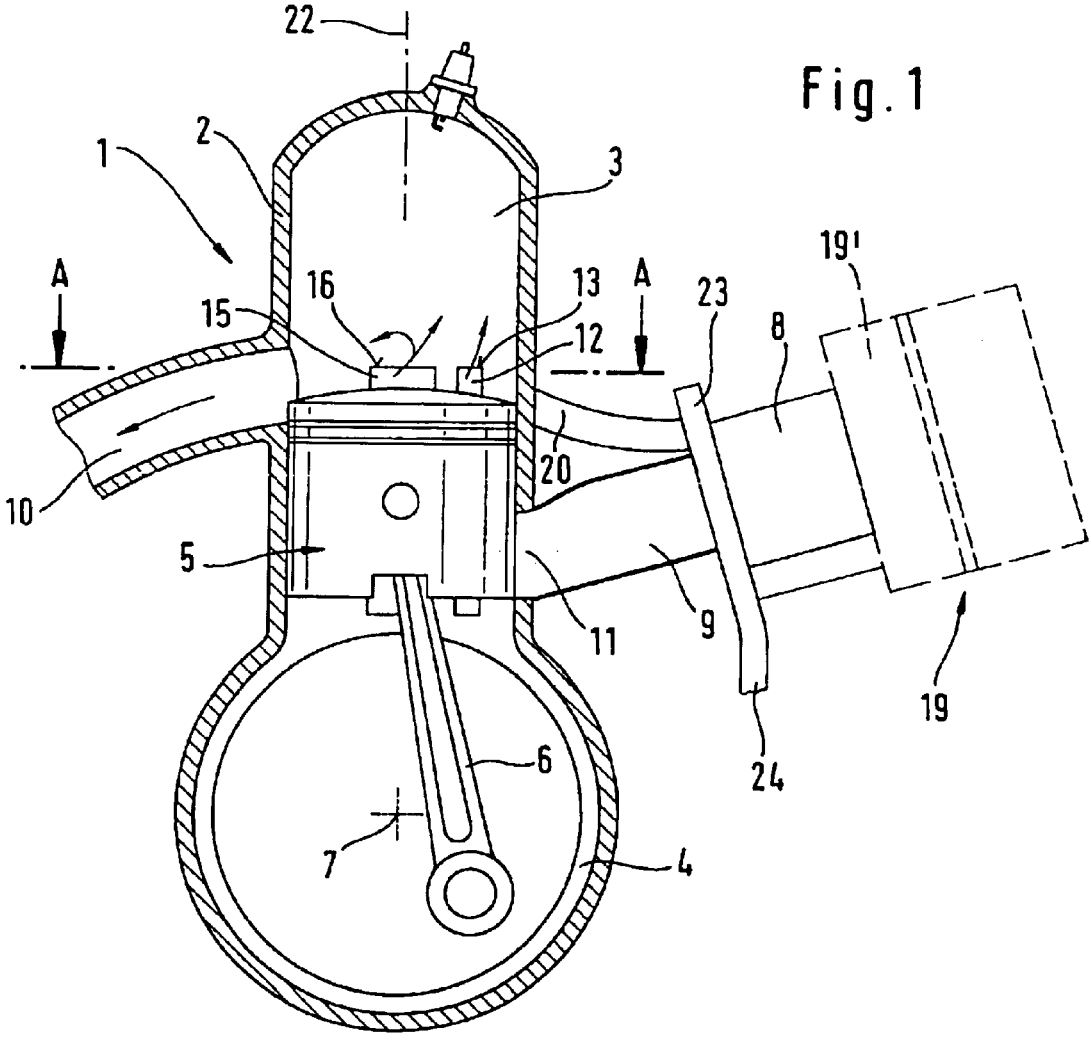
FIG. 1 is a longitudinal section through the schematic structure of a two-cycle engine having scavenging.

The portable, manually-guided implement of the present invention comprises an internal combustion engine having a cylinder with a combustion chamber that has an exhaust gas outlet, wherein the combustion chamber is delimited by a piston that drives a crankshaft that is rotatably mounted in a crankcase, wherein a cylinder plane, which contains the cylinder axis, approximately divides the exhaust gas outlet, wherein a respective transfer channel is provided on each side of the cylinder plane and each transfer channel connects the crankcase with the combustion chamber, wherein a first end of a transfer channel opens into the combustion chamber via an inlet window, and a second end thereof is open toward the crankcase, wherein both of the transfer channels are connected to an air duct that supplies essentially fuel-free combustion air, wherein a carburetor is provided and has a flow channel which, upstream of a butterfly valve, is connected to a clean chamber of an air filter, and, downstream of the butterfly valve, is connected to an intake channel of the engine, wherein a housing wall is disposed between the carburetor and the cylinder, and wherein a duct section of the air duct is formed in the housing wall as a rigid duct.

The housing wall positioned between the carburetor and the cylinder serves as a thermal separation between the carburetor and the cylinder and also contains an integrated duct section. The duct section formed in the housing wall allows an air duct to be positioned between the air filter and the cylinder of the internal combustion engine while requiring a minimum of installation space. In addition, the air duct is installed partly in the engine and partly in the housing, as a result of which it is possible to connect the duct section in the housing wall in a simple fashion by means of hoses or similar devices, while the connection of the main air duct to the air filter in the housing can be effected in the carburetor body itself.

The air duct section in the housing wall is advantageously composed of two halves, one half being designed in one piece with the housing wall and the other half being fixed to the housing wall as a separate component. The half in the housing wall can be molded simply during the manufacture of the housing wall without technical complexity, while the other half can be manufactured simply in a separate production process. The halves engage with each other at a sealing edge and thereby form a largely air-tight and rigid duct section in the housing wall.

In a particular embodiment of the invention the duct section in the housing wall, with its roughly circular to oval cross-section, forms a duct branch between a main air supply duct and the air discharge ducts which are connected to the transfer channels. The duct branch which would otherwise occupy a significant amount of installation space is thus integrated into the housing wall in such a manner that only short, straight duct sections are required to make the connections to the air filter and the cylinder. Here the main air supply duct lies in a first plane and the air discharge ducts lie in a second plane, the two planes lying a certain distance apart in a vertical orientation of the housing wall.

The duct section in the housing wall is essentially U-shaped or semi-circular in shape and encompasses the connecting opening of the intake channel to the diaphragm-type carburetor provided in the housing wall. A main connector for the main air duct is preferably located beneath the carburetor, while the air connectors formed onto the housing wall on the side of the cylinder are located approximately at the level of the carburetor. The air connectors and the main air connector are located in the corners of a triangle, in particular an equilateral triangle.

The main air duct is advantageously designed as a length of tube which forms a sub-assembly with the carburetor. To this end the length of tube has a fixing flange which is fixed to the carburetor body.

Further features of the invention will be described in detail subsequently.

DESCRIPTION OF PREFERRED EMBODIMENTS

Figure 2:
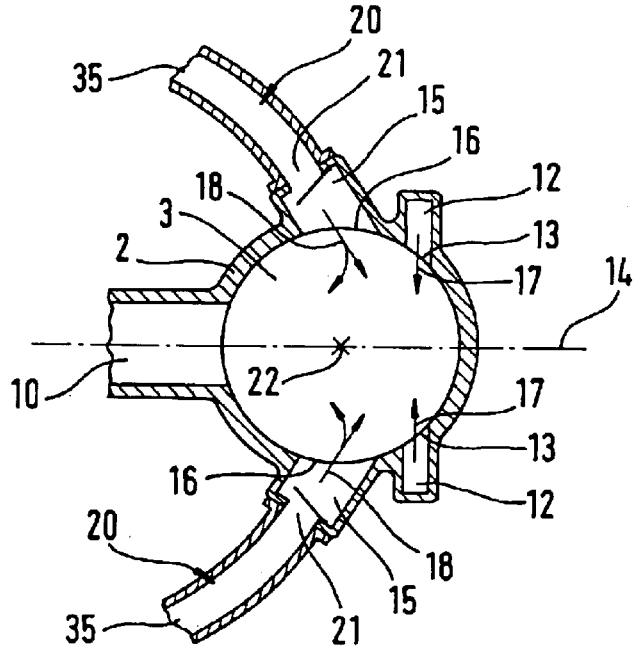
FIG. 2 is a cross section through the cylinder along the line marked A—A in FIG. 1.
Figure 3:
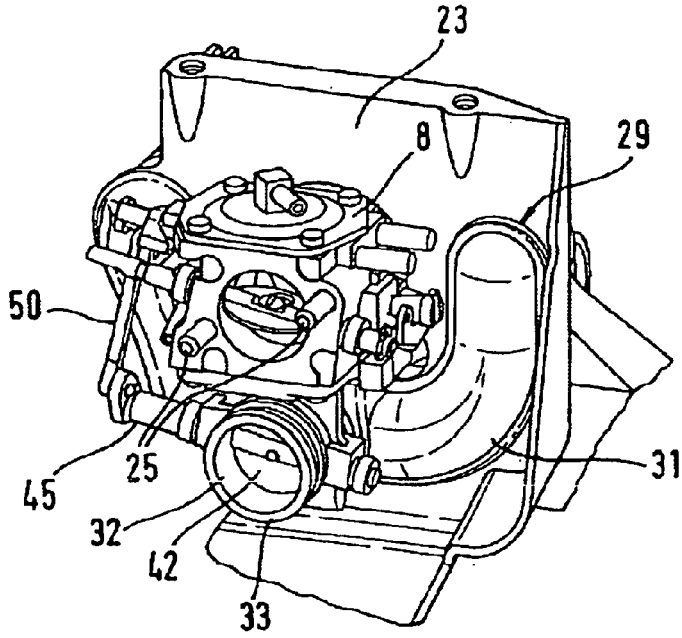
FIG. 3 is a perspective view of a housing wall between the cylinder and a carburetor.

Referring now to the drawings in detail, the internal combustion engine 1 illustrated schematically in FIGS. 1 and 2 is preferably a single cylinder engine which works on the two stroke or cycle principle and can be operated as a forward positioned scavenging air engine or a stratified charge engine. A two-cycle engine of this type can advantageously be used as the drive engine in portable, manually operated tools or implements such as power chain saws, cut-off machines, brush cutters, hedge clippers, etc.

The internal combustion engine 1 essentially comprises a cylinder 2, a crankcase 4 and a piston 5 which reciprocates in the cylinder 2. Together with the cylinder 2 the piston 5 delimits a combustion chamber 3 and, via a connecting rod 6, drives a crankshaft 7 which is mounted in the crankcase 4 in such a manner that it can rotate. The exhaust gases are expelled from the combustion chamber 3 via an outlet or exhaust port 10. The fuel/air mixture required to operate the engine is drawn into the crankcase 4 via a carburetor 8, preferably a diaphragm-type carburetor, through an intake channel 9 and an inlet 11.

In the illustrated embodiment, the crankcase 4 is connected to the combustion chamber 3 via four transfer channels 12,15. The inlet windows 13,16 of the transfer channels 12,15 open or discharge into the combustion chamber 3 and lie roughly opposite one another relative to a cylinder plane 14. The cylinder axis 22 lies in the cylinder plane 14 which divides the exhaust port approximately in half. The transfer channels 12,15 are positioned in pairs on either side of the cylinder plane 14.

Measured around the circumference of the cylinder 2, the inlet windows 13 of the transfer channels 12 are positioned further away from the exhaust port 10 than are the inlet windows 16 of the transfer channels 15. The transfer channels 15 are therefore referred to as being located close to the exhaust port 10 while the transfer channels 12 are referred to as being located remote from the exhaust port 10.

In the embodiment shown, the transfer channels 15 located close to the exhaust port 10 are connected via a diaphragm valve 21 to an external air duct 20 via which essentially exclusively fuel-free air is supplied to the transfer channels 15 close to the exhaust port 10. It can also be useful to feed fuel-free air to the transfer channels 12 disposed remote from the exhaust port 10.

The piston 5 controls the exhaust port 10, the inlet 11 and the inlet windows 13 and 16 of the transfer channels 12 and 15 in a known manner. As the piston 5 travels upwards, all the ducts discharging into the combustion chamber 3 are closed, while the inlet 11, which is connected to the diaphragm-type carburetor 8, is open to the crankcase 4. As the piston 5 travels upwards, underpressure is created in the crankcase 4 which in turn causes a fuel/air mixture to be drawn in via the inlet 11. Since the transfer channels 12 and 15 are open to the crankcase 4, the underpressure prevailing in the crankcase 4 simultaneously effects the induction of air into the transfer channels 15 close to the exhaust port 10 via the air ducts 20 and via the diaphragm valves 21 which open due to the pressure conditions. After one induction process the transfer channels 15 therefore contain essentially clean air.

Following the ignition of the compressed mixture in the combustion chamber 3, which takes place in the area of the upper dead center position, the piston 5 will travel downwards towards the crankcase 4 as a result of the engine explosion pressure, the exhaust port 10 being opened—due to the height position of the inlet windows 13,16—and part of the exhaust gases under pressure being expelled. As the exhaust gas continues to move the piston 5, the inlet windows 13,16 of the transfer channels 12,15 open, preferably only the rich fuel/air mixture drawn into the crankcase 4 flowing through the channels 12. The volume of air previously stored in the transfer channels 15 located close to the exhaust port 10 is pushed into the combustion chamber 3 via the inlet window 16 by the mixture subsequently flowing out of the crankcase. The air which enters in the direction indicated by the arrow 18 positions itself like a protective curtain in front of the exhaust port 10 in such a manner that the rich mixture entering in the direction indicated by the arrow 17 is prevented from flowing out through the exhaust port 10. The scavenging losses are formed essentially by the fuel-free air from the transfer channels 15 close to the exhaust port 10.

The principle of the forward positioned scavenging air engine is described using the example of a diaphragm-controlled scavenging process and is illustrated in FIGS. 1 and 2. Alternatively, it is also possible to design a port-controlled scavenging process in which the air ducts are connected to the inlet windows 16 of the transfer channels 12 close to and/or remote from the exhaust port via a ducted connection in the piston, for example.

The air ducts 20 supplying essentially clean air run from the clean chamber 19' of an air filter 19 to the transfer channels 15 on both sides of the cylinder plane 14. Pursuant to the invention, part of the length of the air ducts 20 are formed in a housing wall 23 of the tool, the housing wall separating the cylinder 2 from a diaphragm-type carburetor 8. This is illustrated schematically in FIG. 1, while FIGS. 3 to 6 show a concrete embodiment thereof.

The housing wall 23 is part of a housing for the tool, e.g. the handle housing 24 (FIG. 5) of a cut-off machine or power chain saw. The carburetor 8 is fixed to the housing wall 23 by means of stud bolts 25 as shown in the sectional view in FIG. 6. The stud bolts 25 are advantageously held in the housing wall 23 in a positive fit.

The carburetor 8 is designed as a diaphragm-type carburetor and provided in a known manner with a butterfly valve or throttle 26 and a choke valve 27, both of which are positioned in the flow channel of the carburetor 8 in such a manner that they can be rotated by means of a shaft. The intake channel 9 preferably takes the form of an elastic duct and is connected to a flow opening 23' in the housing wall 23. The stud bolts 25 are also usefully used to fix the air filter 19 to the carburetor body.

Figure 4:
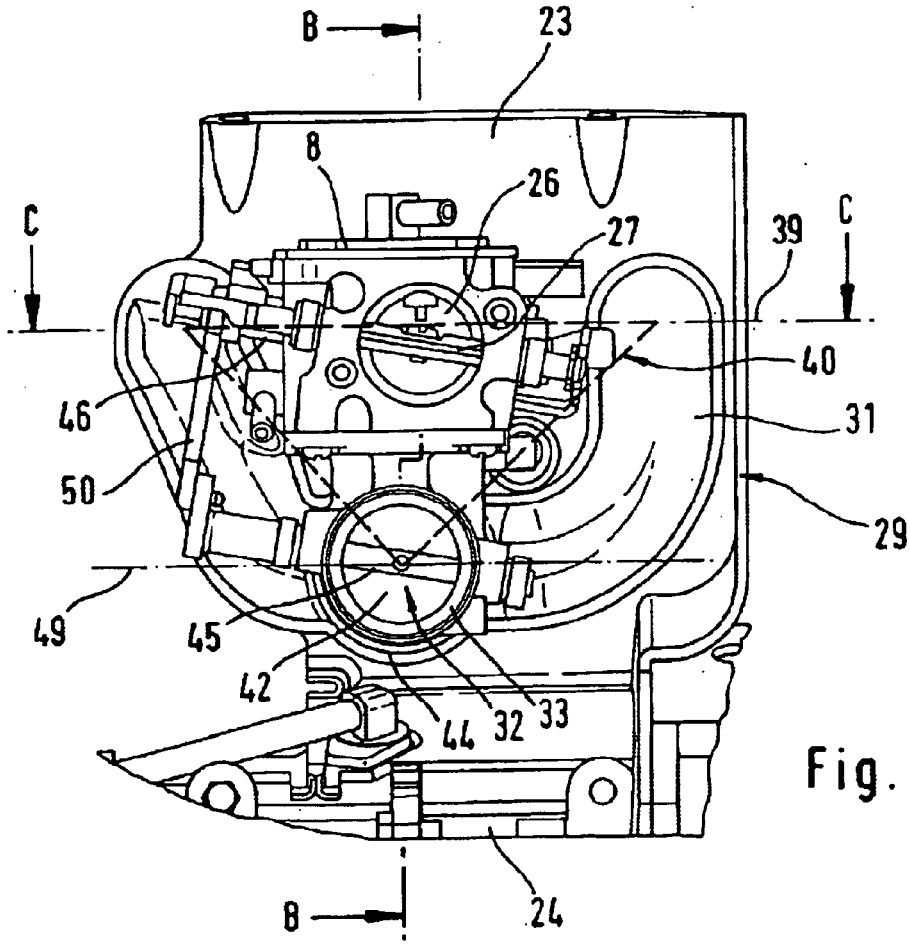
FIG. 4 is a front view of the housing wall shown in FIG. 3.

The air ducts 20 supply essentially fuel-free air from the clean chamber 19' of the air filter 19 to the transfer channels 15, which are preferably located close to the exhaust port 10. The design is such that a part of the air supply duct from the air filter 19 to the internal combustion engine 1 is formed in the housing wall 23. To this end, a first half 30 of a duct section 29 is formed in the housing wall 23, this duct section 29 encompassing the carburetor 8 or the flow opening 23' of the intake channel 9 in an approximate U-shape or semicircle as shown in FIG. 4. The first half 30 is open on the side of the housing wall 23 facing the air filter 19. To form the duct, the half 30 is closed by means of a separate, second half 31 which is placed on the half 30 formed as one part with the housing wall 23 such that it is largely air tight from the air filter 19 side. The second half 31 thus forms a separate component, which is fixed onto the first half 30 in the housing wall 23 preferably by means of bonding, ultrasound welding or a similar process. Here a sealing edge 28 on one of the halves 30, 31 engages with the other half 30, 31. In the embodiment illustrated, a sealing edge 28 on the second half 31 which is designed separately from the housing wall 23 engages in a corresponding sealing joint on the first half 30.

The duct section 29 formed in the housing wall 23 is designed as a duct branch between a main air supply duct 32 and the discharge air ducts 20 which are connected to the transfer channels 15. The main air supply duct 32 is formed by a cylindrical tube section 33 which usefully forms the direct connection between the air filter 19 or the air filter base and the duct section 29 formed in the housing wall 23.

The duct section 29 formed in the housing wall 23 is incorporated into the air duct system via connectors 34, 44.

Figure 6:
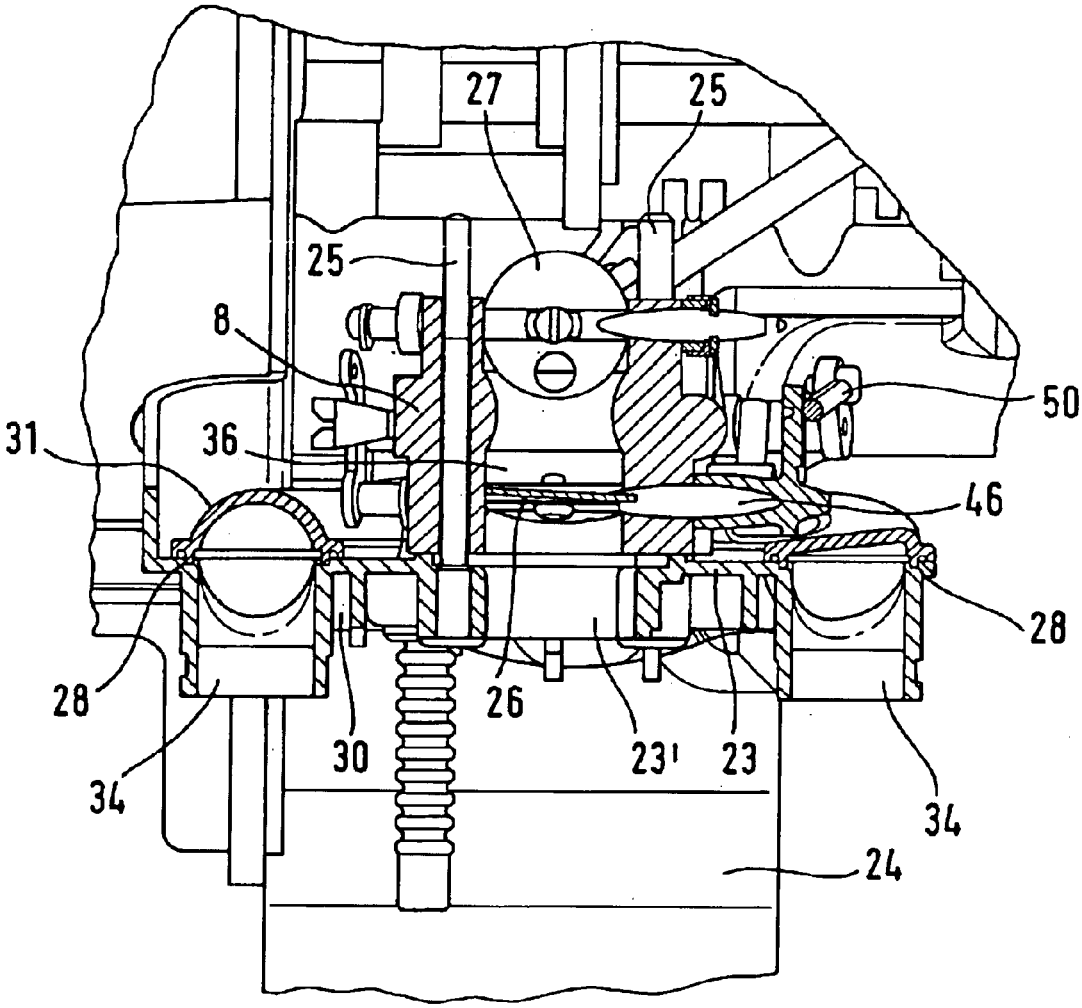
FIG. 6 is a section along the line marked C—C in FIG. 4.

Provided on the side of the housing wall 23 facing the cylinder 2 are air connectors 34, which are provided at the ends of the U-shaped duct section 29 (FIG. 6). Placed on the air connectors 34 are joining pieces 35, the other ends of which are connected to the transfer channels, in the embodiment via the diaphragm valve 21. The duct connection between a particular air connector 34 and a transfer channel 15 which is located close to the exhaust port 10 is preferably of elastic design, in particular taking the form of a hose.

Provided on the side of the housing wall 23 facing away from the cylinder 2 is a main connector 44 which is located roughly centrally in the area of the base of the U-shaped duct section 29. The tube section 33 which, forms the main air duct 32 engages with the main connector 44, the tube section 33 having an outer circumferential groove 43 to receive a sealing ring or similar sealing means.

In the embodiment illustrated, positioned in the tube section 33 is an air control member preferably designed as a choke or air valve 42 which can be pivoted about an axis. The tube section 33 is designed as one part with a fixing flange 41 by means of which the tube section 33 is connected to the housing of the diaphragm-type carburetor 8. The diaphragm-type carburetor 8 and the tube section 33 of the main air duct 32 thus form an assembly, the flow channel 36 in the diaphragm-type carburetor and the main air duct 32 in the tube section 33 running roughly parallel to one another.

Due to their design as one assembly, the diaphragm-type carburetor 8 and the tube section 33 can be assembled before they are mounted to the housing wall 22 so that when the carburetor body is placed on the stud bolts 25 the tube section 33 of the main air duct is simultaneously connected to the main connector 44.

The duct section 29 formed in the housing wall 23 thereby forms a duct branch between the main air supply duct 32 and the air discharge ducts 20 which are connected to the transfer channels. The main air duct 32 lies offset in terms of height in relation to the air ducts 20. The main connector 44 lies in a first plane 49 and the air connectors 34 lie in a second plane 39, roughly in which the longitudinal center line 37 of the flow channel 36 of the diaphragm-type carburetor 8 also lies. The longitudinal center line 38 of the main air duct lies in the first plane 49 of the main connector 44. Both planes 39 and 49 run approximately parallel to one another. The air connectors 34 on one hand and the main connector 44 on the other hand lie approximately perpendicular to the plane of the housing wall 23.

As is shown in FIG. 4, the position of the connectors 34, 44 is chosen such that they are located in the corners of a triangle 40, in particular an equilateral triangle. The main connector 44 is located at the point at the tip of the triangle 40. The air connectors 34 are located in the corners of the base of the triangle 40. The air connectors 34 thus lie approximately diametrically opposite each other in relation to the longitudinal center line 37 of the diaphragm-type carburetor 8.

Figure 5:
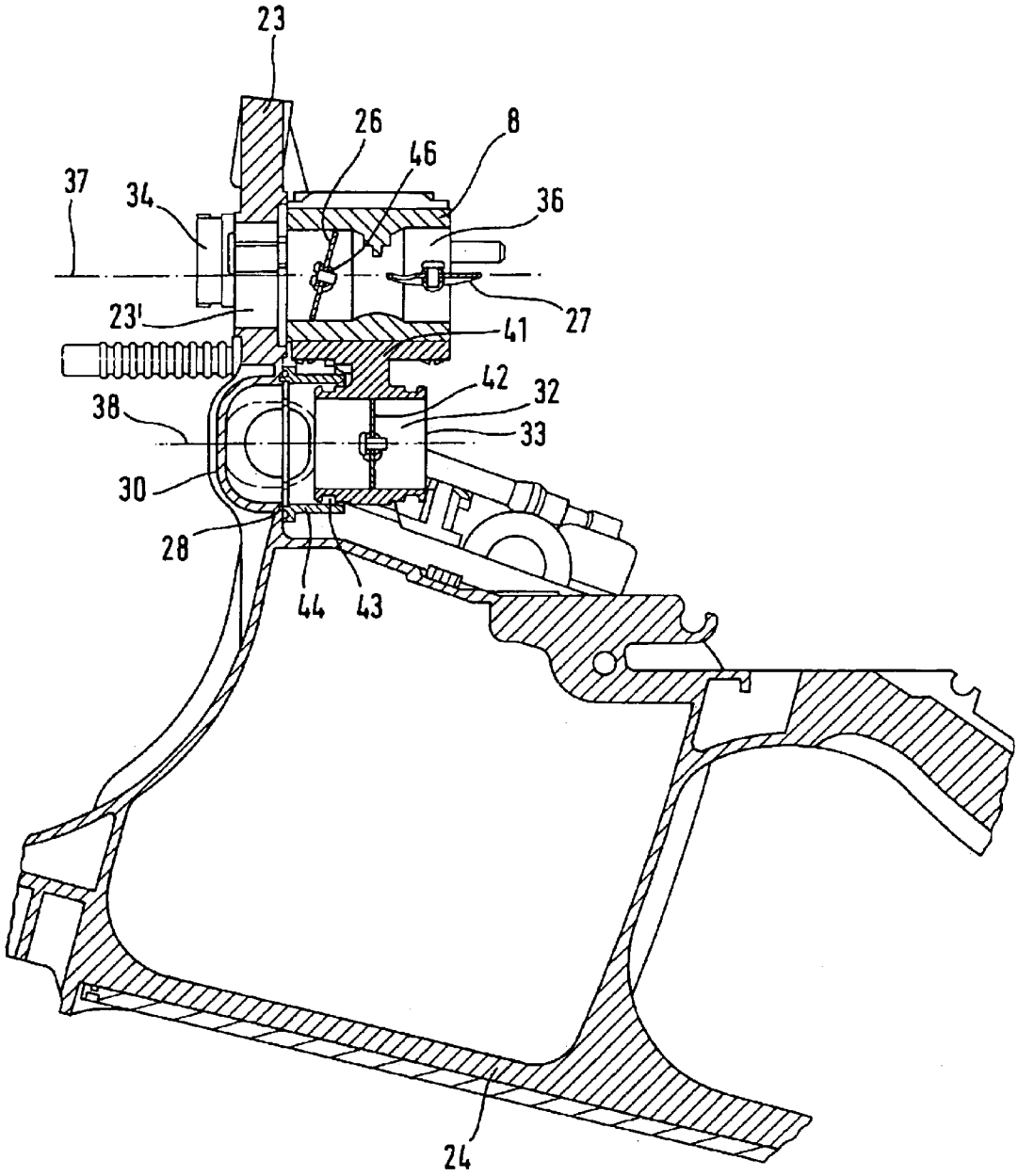
FIG. 5 is a section along the line marked B—B in FIG. 4.

As shown in FIGS. 4 and 5, the main connector 44 is formed as one part with the separate half 31 such that simple manufacture is possible. The half 31 covers the entire length of the half 30 which is formed in the housing wall.

As also shown in FIG. 4, the shaft 45 of the air valve 42 and the shaft 46 of the butterfly valve 26 are located approximately parallel to one another and are linked together, dependent on position, by means of a control linkage 50. It is thus possible, when the engine is at idle for example, for the main air duct 32 to be closed and mixture to be delivered to the combustion chamber 3 via both transfer channels 12, 15. Only when the butterfly valve 26 has been opened up to part throttle is the air valve 42 opened accordingly in order to achieve forward scavenging air positioning or charge stratification.

Due to the butterfly valve 26 located close to the housing wall 23, the control linkage 50 requires adequate installation space and the second half 31 which forms the duct is therefore flattened in the area of the control linkage 50. Since the first half 30 which is formed in the housing wall 23 guarantees an adequate duct cross-section, the flattening of the second half 31 placed upon it has no significant effect on the air supply to the internal combustion engine. As is shown in particular in FIG. 6, in order to create sufficient installation space in which to connect the butterfly valve and the choke valve via the control linkage 50, the shape of the half 31 in the area of the control linkage 50 must be appropriate, as a result of which it has a cross section which is oval or flattened on one side rather than circular.

The specification incorporates by reference the disclosure of German priority document DE 102 22 346.7 filed May 21, 2002.

The present invention is, of course, in no way restricted to the specific disclosure of the specification and drawings, but also encompasses any modifications within the scope of the appended claims.

We claim:

1. A portable, manually-guided implement, comprising:

an internal combustion engine having a cylinder with a combustion chamber having an exhaust gas outlet, wherein said combustion chamber is delimited by a piston that drives a crankshaft that is rotatably mounted in a crankcase, wherein a cylinder plane, which contains a cylinder axis, approximately divides said exhaust gas outlet, wherein a respective transfer channel is provided on opposite sides of said cylinder plane and each connects said crankcase with said combustion chamber, wherein a first end of each transfer channel opens into said combustion chamber via an inlet window, and a second end thereof is open towards said crankcase, wherein both of said transfer channels are connected to an air duct that supplies essentially fuel-free combustion air, wherein a carburetor is provided and has a flow channel which, upstream of a butterfly valve therein, is connected to a clean chamber of an air filter, and, downstream of said butterfly valve, is connected to an intake channel of said engine, wherein a housing wall is disposed between said carburetor and said cylinder, wherein said housing wall is part of a housing of said implement and separates said carburetor from said cylinder, and wherein a duct section of said air duct is formed in said housing wall as a rigid duct.

2. An implement according to claim 1, wherein said duct section is composed of a first half and a second half, wherein said first half is monolithically formed with said housing wall, and said second half is a separate component that is fixed in position on said housing wall.

3. An implement according to claim 2 wherein one of said halves is provided with a sealing edge via which it engages the other of said halves.

4. An implement according to claim 2, wherein said duct section that is formed in said housing wall is a duct branch between a main air supply channel and said air ducts that are connected to said transfer channels.

5. An implement according to claim 4, wherein said housing wall, on a side that faces said cylinder, is provided with air connectors for a connection to said air ducts.

6. An implement according to claim 5, wherein said air connectors are disposed next to one another at approximately the same level.

7. An implement according to claim 6, wherein said air connectors are disposed diametrically relative to said flow channel of said carburetor.

8. An implement according to claim 5, wherein a main connector is provided on a side of said housing wall remote from said cylinder for a connection to said main air channel.

9. An implement according to claim 8, wherein said main connector, and said second half of said duct section, form a single component.

10. An implement according to claim 8, wherein said main air supply channel is disposed on a first plane, and said air ducts are disposed on a second plane.

11. An implement according to claim 8, wherein said main connector is disposed below said carburetor.

12. An implement according to claim 8, wherein said air connectors and said main connector are disposed in the corners of a triangle.

13. An implement according to claim 12, wherein said triangle is an equilateral triangle.

14. An implement according to claim 8, wherein disposed in said main channel is a throttle element for controlling a flow cross-section.

15. An implement according to claim 14, wherein said throttle element is an air valve.

16. An implement according to claim 14, wherein said throttle element is disposed in a tube section.

17. An implement according to claim 16, wherein said tube section is secured to a housing of said carburetor.

18. An implement according to claim 16, wherein said tube section engages in said main connector.

19. An implement according to claim 8, wherein at least one of a channel connection between one of said air connectors and a transfer channel, and a channel connection between said main connector and said air filter, is formed by an elastic connecting element.

20. An implement according to claim 19, wherein said elastic connecting element is in the form of a hose.

21. An implement according to claim 1, wherein said duct section that is formed in said housing wall extends in a semicircular manner.

22. An implement according to claim 21, wherein said duct section encompasses a connecting opening formed in said housing wall between said intake channel of said engine and said flow channel of said carburetor.

* * * * *